US009935361B2

(12) United States Patent
Chang et al.

(10) Patent No.: US 9,935,361 B2
(45) Date of Patent: Apr. 3, 2018

(54) MIRRORED ANTENNA SYSTEM AND METHOD FOR BEAM STEERING FOR SAR MITIGATION

(71) Applicant: Dell Products L.P., Round Rock, TX (US)

(72) Inventors: Ching-Wei Chang, New Taipei (TW); I-Yu Chen, Taipei (TW)

(73) Assignee: Dell Products L.P., Round Rock, TX (US)

( * ) Notice: Subject to any disclaimer, the term of this patent is extended or adjusted under 35 U.S.C. 154(b) by 92 days.

(21) Appl. No.: 15/042,672

(22) Filed: Feb. 12, 2016

(65) Prior Publication Data

US 2017/0237153 A1 Aug. 17, 2017

(51) Int. Cl.

| | |
|---|---|
| ***H01Q 3/24*** | (2006.01) |
| ***H01Q 1/24*** | (2006.01) |
| ***H01Q 17/00*** | (2006.01) |
| ***H01Q 15/00*** | (2006.01) |

(52) U.S. Cl.

CPC ..... *H01Q 1/245* (2013.01); *H01Q 1/24* (2013.01); *H01Q 1/243* (2013.01); *H01Q 3/24* (2013.01); *H01Q 15/0006* (2013.01); *H01Q 17/001* (2013.01)

(58) Field of Classification Search

USPC ..... 343/876, 702; 375/267

See application file for complete search history.

(56) References Cited

U.S. PATENT DOCUMENTS

| | | | | |
|---|---|---|---|---|
| 8,159,399 | B2 * | 4/2012 | Dorsey | H01Q 1/2266 343/702 |
| 2012/0329407 | A1 * | 12/2012 | Rousu | H01Q 3/2605 455/90.2 |
| 2013/0176189 | A1 * | 7/2013 | Kodama | H01Q 1/243 343/876 |

* cited by examiner

*Primary Examiner* — Jessica Han
*Assistant Examiner* — Hai Tran
(74) *Attorney, Agent, or Firm* — Baker Botts L.L.P.

(57) ABSTRACT

A mirrored antenna system for beam steering in an information handling system is disclosed. The mirrored antenna system includes a first antenna and a second antenna configured to operate alternatively as a radiator and as a reflector. The first and the second antenna are arranged in mirror symmetry to one another and separated by a dielectric medium. The mirrored antenna system further includes a switch coupled to the first antenna and the second antenna configured to switch the feed in response to a trigger.

20 Claims, 7 Drawing Sheets

MIRRORED ANTENNA SYSTEM AND METHOD FOR BEAM STEERING FOR SAR MITIGATION

BACKGROUND

Field of the Disclosure

This disclosure relates generally to information handling systems and more particularly to a mirrored antenna system for beam steering in an information handling system.

Description of the Related Art

As the value and use of information continues to increase, individuals and businesses seek additional ways to process and store information. One option available to users is information handling systems. An information handling system generally processes, compiles, stores, and/or communicates information or data for business, personal, or other purposes thereby allowing users to take advantage of the value of the information. Because technology and information handling needs and requirements vary between different users or applications, information handling systems may also vary regarding what information is handled, how the information is handled, how much information is processed, stored, or communicated, and how quickly and efficiently the information may be processed, stored, or communicated. The variations in information handling systems allow for information handling systems to be general or configured for a specific user or specific use such as financial transaction processing, airline reservations, enterprise data storage, or global communications. In addition, information handling systems may include a variety of hardware and software components that may be configured to process, store, and communicate information and may include one or more computer systems, data storage systems, and networking systems.

An information handling system may include antennas. The antennas may emit electromagnetic waves in the direction of the information handling system user at levels that surpass specific absorption rate (SAR) regulatory levels established by each country. Accordingly, to meet SAR regulatory requirements, an antenna's main gain beam may be steered away from a user or human body when human proximity is detected near the information handling system.

SUMMARY

In one aspect, a disclosed mirrored antenna system for beam steering within an information handling system may comprise a first antenna and a second antenna configured to operate alternatively as a radiator and as a reflector. The first antenna and the second antenna may be arranged in mirror symmetry to one another and separated by a dielectric medium. The mirrored antenna system may further include a switch coupled to the first antenna and the second antenna. The switch may be configured to switch the feed in response to a trigger.

Another disclosed aspect includes an information handling system with a mirrored antenna system for beam steering. The mirrored antenna system may comprise a first antenna and a second antenna configured to operate alternatively as a radiator and as a reflector. The first antenna and the second antenna may be arranged in mirror symmetry to one another and separated by a dielectric medium. The mirrored antenna system may further include a switch coupled to the first antenna and the second antenna. The switch may be configured to switch the feed in response to a trigger.

Another disclosed aspect includes a method for beam steering within an information handling system. The method for beam steering may comprise operating a first antenna in a first mirrored antenna system in a radiator mode and operating a second antenna in the first mirrored antenna system in a reflector mode in relation to the radiator mode of the first antenna. The method for beam steering may include determining a change in capacitance upon human detection. The method for beam steering may further include switching the first antenna from the radiator mode to the reflector mode and switching the second antenna from the reflector mode to the radiator mode.

BRIEF DESCRIPTION OF THE DRAWINGS

For a more complete understanding of the present invention and its features and advantages, reference is now made to the following description, taken in conjunction with the accompanying drawings, in which.

DESCRIPTION OF PARTICULAR EMBODIMENT(S)

Figure 1:
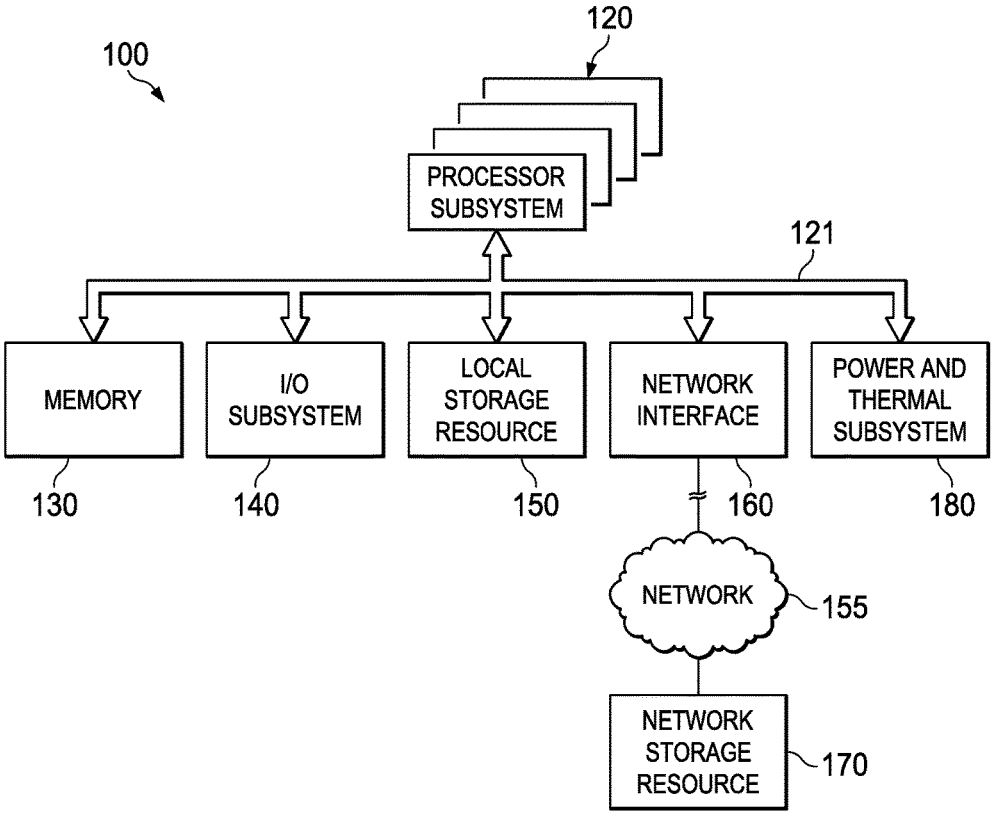
FIG. 1 is a block diagram of selected elements of an embodiment of an information handling system.

In the following description, details are set forth by way of example to facilitate discussion of the disclosed subject matter. It should be apparent to a person of ordinary skill in the field, however, that the disclosed embodiments are exemplary and not exhaustive of all possible embodiments.

Throughout this disclosure, a hyphenated form of a reference numeral refers to a specific instance of an element and the un-hyphenated form of the reference numeral refers to the element generically or collectively. Thus, as an example (not shown in the drawings), widget "12-1" refers to an instance of a widget class, which may be referred to collectively as widgets "12" and any one of which may be referred to generically as a widget "12". In the figures and the description, like numerals are intended to represent like elements.

For the purposes of this disclosure, an information handling system may include an instrumentality or aggregate of instrumentalities operable to compute, classify, process, transmit, receive, retrieve, originate, switch, store, display, manifest, detect, record, reproduce, handle, or utilize various forms of information, intelligence, or data for business, scientific, control, entertainment, or other purposes. For example, an information handling system may be a server, a personal computer, a PDA, a consumer electronic device, a network storage device, or another suitable device and may vary in size, shape, performance, functionality, and price. The information handling system may include memory, one or more processing resources such as a central processing unit (CPU) or hardware or software control logic. Additional components of the information handling system may include one or more storage devices, one or more communications ports for communicating with external devices as well as various input and output (I/O) devices, such as a keyboard, a mouse, and a video display. The information handling system may also include one or more buses operable to transmit communication between the various hardware components.

Particular embodiments are best understood by reference to FIGS. 1-6 wherein like numbers are used to indicate like and corresponding parts.

FIG. 1 illustrates a block diagram of selected functional elements of an embodiment of an information handling system 100. As discussed above, information handling system 100 may be used to process and store information for various purposes. As will be described in more detail below, information handling system 100 may include various systems and apparatuses such as antennas. In FIG. 1, external or remote elements such as network 155 and network storage resource 170 are also shown to give context to an environment in which information handling system 100 may be configured to operate.

As shown in FIG. 1, components of information handling system 100 may include, but are not limited to, processor subsystem 120, which may comprise one or more processors, and system bus 121 that communicatively couples various system components to processor subsystem 120 including, for example, memory subsystem 130, I/O subsystem 140, local storage resource 150, network interface 160, and power and thermal subsystem 180. System bus 121 may represent a variety of suitable types of bus structures, such as a memory bus, a peripheral bus, or a local bus using various bus architectures in selected embodiments. For example, such architectures may include, but are not limited to, Micro Channel Architecture (MCA) bus, Industry Standard Architecture (ISA) bus, Enhanced ISA (EISA) bus, Peripheral Component Interconnect (PCI) bus, PCI Express (PCIe) bus, HyperTransport (HT) bus, and Video Electronics Standards Association (VESA) local bus.

In FIG. 1, network interface 160 may include a suitable system, apparatus, or device operable to serve as an interface between information handling system 100 and a network 155. For example, network interface 160 may include a wireless interface module. A wireless interface module may be configured to transmit and/or receive radio frequency signals. Accordingly, a wireless interface module may be capable of providing bidirectional communications with other information handling systems. A wireless interface module also may be configured to provide reception and/or transmission if there is sufficient unidirectional data exchange. An antenna system, such as mirrored antenna system 200 discussed below in reference to FIG. 2, may be configured to transmit, receive, or both transmit and receive radio frequency signals. As will be described in more detail below, mirrored antenna system 200 may also include two antennas, each antenna configured to switch between operating as a radiator and as a reflector.

Network interface 160 may enable information handling system 100 to communicate over network 155 using a suitable transmission protocol and/or standard, including, but not limited to, transmission protocols and/or standards enumerated below with respect to the discussion of network 155. In some embodiments, network interface 160 may be communicatively coupled via network 155 to network storage resource 170. Network 155 may be implemented as, or may be a part of, a network attached storage (NAS), a storage area network (SAN), personal area network (PAN), local area network (LAN), a metropolitan area network (MAN), a wide area network (WAN), a wireless wide area network (WWAN), a wireless local area network (WLAN), a virtual private network (VPN), an intranet, the Internet or another appropriate architecture or system that facilitates the communication of signals, data and/or messages (generally referred to as data). Network 155 may transmit data using a desired storage and/or communication protocol, including, but not limited to, Fibre Channel, Frame Relay, Asynchronous Transfer Mode (ATM), Internet protocol (IP), other packet-based protocol, small computer system interface (SCSI), Internet SCSI (iSCSI), Serial Attached SCSI (SAS) or another transport that operates with the SCSI protocol, advanced technology attachment (ATA), serial ATA (SATA), advanced technology attachment packet interface (ATAPI), serial storage architecture (SSA), integrated drive electronics (IDE), and/or any combination thereof. Network 155 and its various components may be implemented using hardware, software, or any combination thereof. In certain embodiments, information handling system 100 and network 155 may be included in a rack domain.

As depicted in FIG. 1, processor subsystem 120 may comprise a system, device, or apparatus operable to interpret and/or execute program instructions and/or process data, and may include one or more microprocessors, microcontrollers, digital signal processors (DSPs), application specific integrated circuits (ASICs), system on chip (SOC), or other digital or analog circuitry configured to interpret and/or execute program instructions and/or process data. In some embodiments, processor subsystem 120 may interpret and/or execute program instructions and/or process data stored locally (e.g., in memory subsystem 130). In the same or alternative embodiments, processor subsystem 120 may interpret and/or execute program instructions and/or process data stored remotely (e.g., in network storage resource 170).

Also in FIG. 1, memory subsystem 130 may comprise a system, device, or apparatus operable to retain and/or retrieve program instructions and/or data for a period of time (e.g., computer-readable media). Memory subsystem 130 may comprise random access memory (RAM), electrically erasable programmable read-only memory (EEPROM), a PCMCIA card, flash memory, magnetic storage, opto-magnetic storage, and/or a suitable selection and/or array of volatile or non-volatile memory that retains data after power to its associated information handling system, such as information handling system 100, is powered down.

In FIG. 1, local storage resource 150 may comprise computer-readable media (e.g., hard disk drive, solid state drive, floppy disk drive, CD-ROM, and/or other types of rotating storage media, flash memory, EEPROM, and/or other types of solid state storage media) and may be generally operable to store instructions and/or data. For example, local storage resource 150 may store executable code in the form of program files that may be loaded into memory subsystem 130 for execution. In information handling system 100, I/O subsystem 140 may comprise a system, device, or apparatus generally operable to receive and/or transmit data to/from/within information handling system 100. I/O subsystem 140 may represent, for example, a variety of communication interfaces, graphics interfaces, video interfaces, user input interfaces, and/or peripheral interfaces.

As shown, information handling system 100 may also include a power and thermal subsystem 180. Power and thermal subsystem 180 may be implemented in any suitable manner. For example, power and thermal subsystem 180 may include one or more components such as power supplies, power controllers, fans, fan controllers, heat sinks, air baffles, etc., configured to provide power to components within information handling system 100 and to ensure that thermal design constraints for the components are met (e.g., by cooling the components). Accordingly, certain components included within information handling system 100 (e.g., components within processor subsystem 120, memory 130, etc.) may operate by consuming power provided by power and thermal subsystem 180. In certain examples, designers of information handling system 100 may budget and account for power expected to be consumed by one or more of the components and may design power and thermal subsystem 180 to include an appropriate power supply configured to power the components.

Figure 2A:
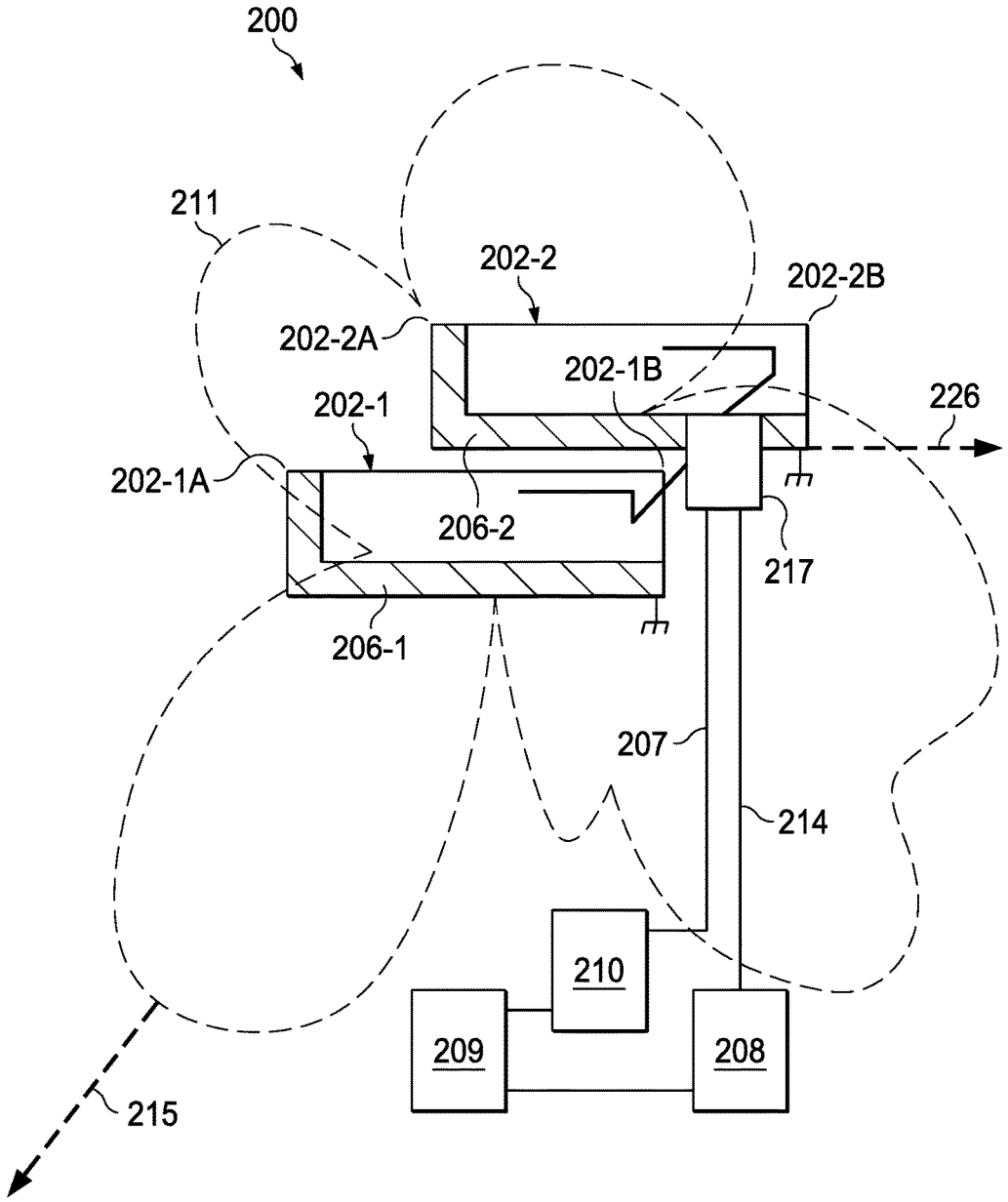
FIGS. 2A and 2B are isometric views of selected elements of an embodiment of a mirrored antenna system used within an information handling system.
Figure 2B:
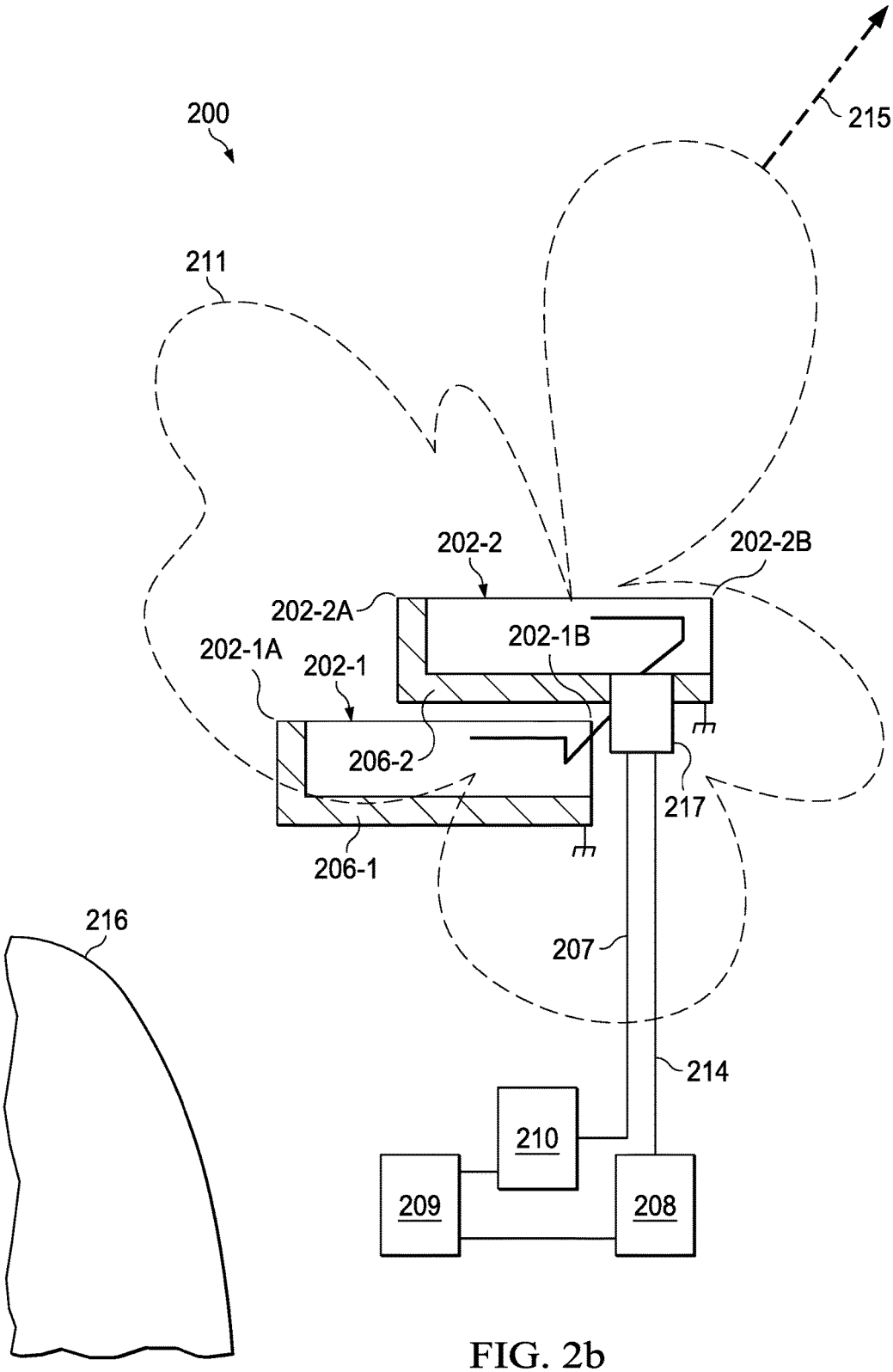

FIGS. 2A and 2B show mirrored antenna system 200 for use within an information handling system, such as information handling system 100 described above in reference to FIG. 1. Specifically, FIG. 2A shows the embodiment of mirrored antenna system 200 having antenna 202-1 operating as a radiator while antenna 202-2 operates as a reflector. FIG. 2B shows the embodiment of mirrored antenna system 200 having antenna 202-1 operating as a reflector while antenna 202-2 operates as a radiator.

The components shown in FIGS. 2A and 2B are not drawn to scale and mirrored antenna system 200 may contain additional or fewer components than the components shown in FIGS. 2A and 2B. Components of mirrored antenna system 200 may be interconnected with each other as well as with other components not shown in FIGS. 2A and 2B. For example, mirrored antenna system 200 may be interconnected with one or more other mirrored antenna systems as will be discussed below. However, connections between components may be omitted in FIGS. 2A and 2B for descriptive clarity.

Mirrored antenna system 200 may include antenna 202-1 and antenna 202-2. Antenna 202-1 and antenna 202-2 may be any kind of antenna known in the art, including but not limited to monopole, dipole, patch, beam-forming, and spatial multiplexing antennas. Each of antenna 202 may include a respective proximity sensor (p-sensor) 206. Each p-sensor 206 may include electrodes configured to detect capacitance. For example, p-sensor 206-1 and p-sensor 206-2 may include electrodes that detect a change in capacitance when a human body is within proximity of the sensors.

Antenna 202-1 and antenna 202-2 may be identical antennas arranged in mirror symmetry to one another with respect to a specified plane, meaning that antenna 202-1 and antenna 202-2 may be arranged such that they are exact reflections of each other. For example, right corner 202-1A of antenna 202-1 may be arranged parallel to and in mirror symmetry with right corner 202-2A of antenna 202-2 with respect to plane x 226. Similarly, left corner 202-1B may be arranged parallel to and in mirror symmetry with left corner 202-2B of antenna 202-2 with respect to plane x 226. Additionally, antenna 202-1 and antenna 202-2 may be separated by a dielectric medium. The distance in separation between antenna 202-1 and antenna 202-2 may be determined by the antenna volume. The antenna volume may be the amount of space the antenna occupies. The antenna volume may be determined by the type of antenna used. For example, a high gain fixed beam antenna may occupy a larger volume than a compact RF antenna. The larger the antenna volume, the more distance in separation between antenna 202-1 and antenna 202-2 that may be required to maintain a certain antenna performance (e.g., desired gain and pattern characteristics). To the contrary, the smaller the antenna volume, the less distance in separation between antenna 202-1 and antenna 202-2 that may be required to maintain a certain antenna performance. The antenna volume also may be determined by the amount of dielectric medium (not shown) present. A dielectric medium may be an electrical insulator. The presence of more dielectric medium may load the antenna and thus may act to reduce the resonant frequency of the antenna. This may result in a smaller antenna volume for radiating at a same frequency. In the mirrored antenna system, there may be more than one antenna configured to operate as a radiator, meaning there may be more dielectric medium. Accordingly, the presence of more dielectric medium may reduce the overall antenna volume, including the distance in space between antenna 202-1 and antenna 202-2, while allowing each antenna 202 to operate at a same RF.

Antenna 202-1 and antenna 202-2 may be connected by central control and switching circuitry (switch) 217. Switch 217 may be coupled to embedded controller (EC) 210 via transmission cable 207. A transmission cable may deliver power to an antenna. Transmission cable 207 may be any known in the art such as a coaxial cable, a microstrip line, or a two wire line. An EC may be a microcontroller that handles various system tasks such as calculating the correct phase angle for each antenna element based on data it may receive from its sensors. The EC also may be configured to issue operating system events, including but not limited to windows management instrumentation (WMI) events.

Switch 217 also may be coupled to wireless module 208 via antenna RF cable 214. RF cable 214 may be any known in the art such as a coaxial cable and may transmit any operational information needed to control antenna 202-1 and antenna 202-2. Operational information may include, but may not be limited to, directivity and gain. Wireless module 208 may be an embodiment of memory subsystem 130 described above with respect to FIG. 1. Wireless module 208 may include any desired information such as instructions, data, and operational parameters for configuring and controlling antenna 202-1 and antenna 202-2 for compliance with SAR regulatory measures. In one embodiment, wireless module 208 may be a WWAN module. The WWAN module may include data such as a dynamic power reduction (DPR) table (not shown). A DPR table may contain data such as the reduction amount of transmission power from the WWAN card (not shown) that is needed to meet SAR regulatory measures. In another, further embodiment, the WWAN module may also include instructions to switch the feed between antenna 202-1 and antenna 202-2 in response to an approaching human body as will be discussed further below.

Wireless module 208 and EC 210 each may connect to a processor, such as processor 120 described above with respect to FIG. 1. In one embodiment, wireless module 208 and EC 210 may connect to a processor such as SOC 209. SOC 209 may include various applications such as software application programming interface (API), which may use data, such as the DPR table, to execute various instructions, such as triggering switch 217 to switch the feed between antenna 202-1 and antenna 202-2. Although not explicitly shown, the circuitry and modules described herein may be implemented as hardware, as software, or as combinations thereof.

Switch 217 may be connected to a p-sensor integrated circuit (IC) (not shown). The p-sensor IC may be connected to each p-sensor 206. When switch 217 is triggered to switch a feed, the p-sensor IC also may be triggered to move from the active or detecting state to the inactive or non-detecting state. Alternatively, p-sensor IC may be triggered to move from the inactive or non-detecting state to the active or detecting state. Only one p-sensor 206, either p-sensor 206-1 or p-sensor 206-2, may be in the active or detecting state at any given time. The active or detecting p-sensor may be the one located on the antenna operating as a radiator. For example, if antenna 202-1 is operating as the radiator, then p-sensor 206-1 may be in the active or detecting state. Accordingly, p-sensor 206-2 associated with antenna 202-2, which may be operating as a reflector, may be in the inactive or non-detecting state. Similarly, if antenna 202-2 is operating as the radiator, then p-sensor 206-2 may be in the active or detecting state, while p-sensor 206-1 associated with antenna 202-1, which may be operating as a reflector, may be in the inactive or non-detecting state.

Switch 217 also may operate to switch the feed between antenna 202-1 and antenna 202-2. Antenna 202-1 and antenna 202-2 are each configured to switch between operating as a radiator and as a reflector. The operation modes of acting as a radiator and acting as a reflector are mutually exclusive modes. This means that an antenna may operate in only one mode at any given time. For example, if an antenna is selected to operate as a reflector, it may operate only as a reflector at that given time. Similarly, if an antenna is selected to operate as a radiator, it may operate only as a radiator at that given time. Thus, one antenna may not be selected to operate as both a reflector and a radiator at the same time. When an antenna is configured to operate as a radiator, the antenna may include one or more radiating elements (not shown). A radiating element may be capable of radiating and receiving electromagnetic waves. A radiating element may be any kind known in the art. For example, a radiating element may be a piece of foil, a coil, or a conductive rod. When an antenna is configured to operate as a reflector, the antenna may include one or more parasitic elements (not shown). A parasitic element may be capable of redirecting electromagnetic waves with a phase of 360 degrees.

FIG. 2A shows antenna 202-1 operating as a radiator and antenna 202-2 operating as a reflector. When switch 217 is in the closed or on position with respect to antenna 202-1, there may be a closed or on electrical connection with one or more radiating elements in antenna 202-1. Thus, antenna 202-1 may operate as a radiator and may radiate or receive electromagnetic signals. When switch 217 is in the open or off position with respect to antenna 202-2, the electrical connection with one or more parasitic elements in antenna 202-2 may be incomplete. Thus, antenna 202-2 may operate as a reflector, redirecting electromagnetic signals (not shown) received by antenna 202-1 away from antenna 202-2. This may cause beam steering of the antenna's main gain beam 215 as shown. Beam steering may refer to changing the direction of the antenna's main gain beam. The antenna's main gain beam may refer to the largest or main lobe of radiation pattern 211.

In one embodiment, when p-sensor 206-1 detects a change in capacitance because of an approaching human body, a sensor signal indicating sensor event information such as a change in capacitance may be transmitted to EC 210 via transmission cable 207. This sensor signal may then be transmitted from EC 210 to SOC 209, which may then trigger the basic input/output system (BIOS) to issue an operating system event, such as a WMI event. The WMI event may then trigger software API. The software API may then use the DPR table in wireless module 208 to send a signal via antenna RF cable 214 to switch 217, instructing the switch to switch 217 in the open or off position with respect to antenna 202-1 and in the closed or on position with respect to antenna 202-2. Once this occurs, antenna 202-1 may operate as a reflector and antenna 202-2 may operate as a radiator. When antenna 202-1 operates as a reflector, it may redirect electromagnetic signals. When antenna 202-2 operates as a radiator, it may radiate or receive electromagnetic signals. Thus, as shown in FIG. 2B, antenna 202-1 may redirect electromagnetic signals (not shown) received by antenna 202-2 away from antenna 202-1, thereby steering the antenna's main beam 215 away from human body 216.

In another, further embodiment, the switching of the feed described above may work in combination with reducing the transmission power of the WWAN card. In this instance, once the software API is triggered, it may trigger the switching of the feed described above and also may select a reduced power state from the DPR table in wireless module 208 to ensure that the human body's SAR exposure meets the SAR regulatory requirements. When the switching of the feed and reduction of transmission power work in combination, less transmission power reduction of the WWAN card may be required than if no mirrored antenna system was present. This is the case because the mirrored antenna system may redirect electromagnetic signals away from the human body, meaning that less transmission power reduction of the WWAN card may be required to meet SAR regulatory requirements. This may then result in better information handling system performance.

Figure 3:
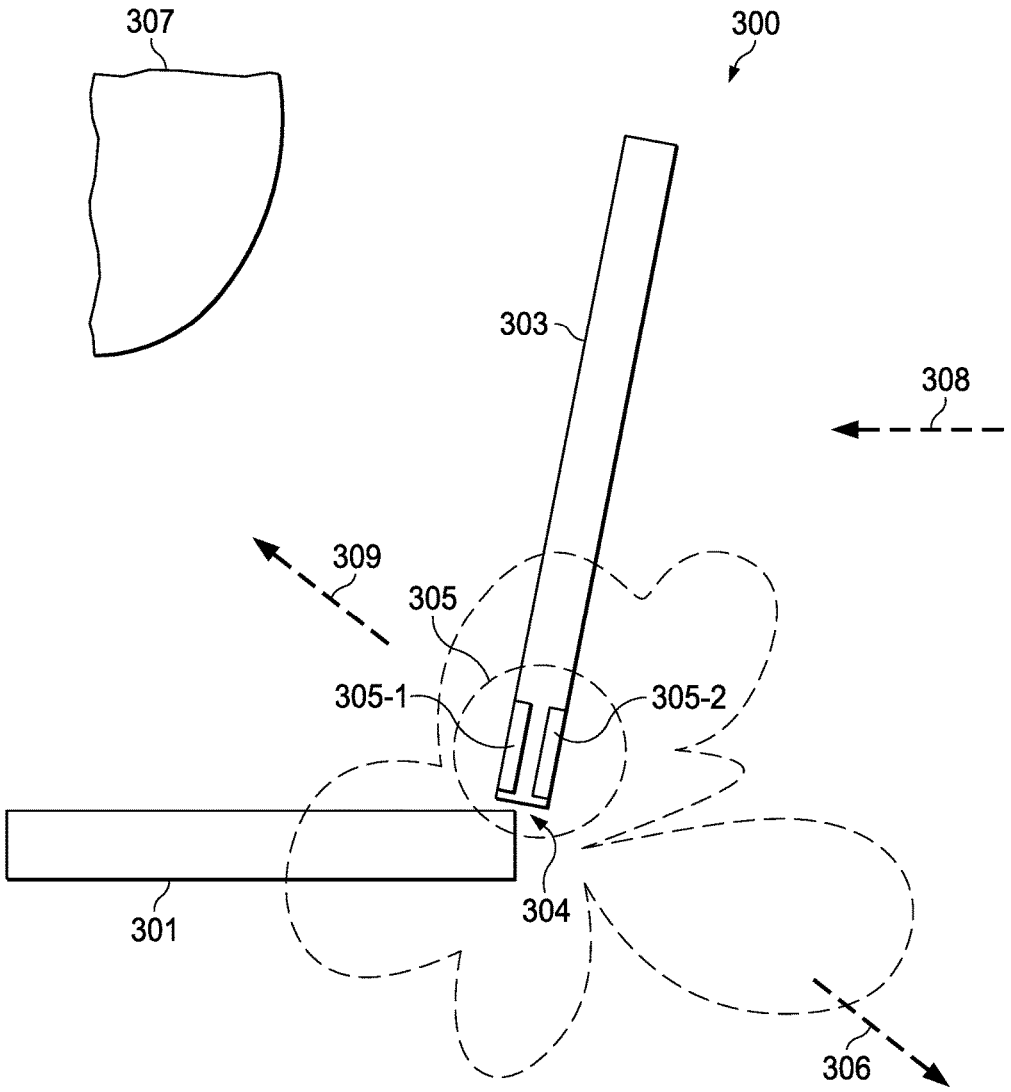
FIG. 3 is a side view of selected elements of an embodiment of a mirrored antenna system used within an information handling system.

FIG. 3 illustrates an embodiment of information handling system 300 with mirrored antenna system 305. In FIG. 3, information handling system 300 is shown as a hinged device with bottom portion 301 rotatably coupled to display portion 303. It should be appreciated, however, that devices and methods described herein can be incorporated in any type of information handling system, including but not limited to tablet devices. The components shown in FIG. 3 are not drawn to scale and information handling system 300 may contain additional or fewer components than the components shown in FIG. 3.

As shown in FIG. 3, mirrored antenna system 305 may be located proximally to hinge 304 in display portion 303. Although not explicitly shown in FIG. 3, other alternatives are contemplated. For example, antenna system 305 may be located distal to hinge 304 in display screen 303. Alternatively, antenna system 305 may be located in a bottom portion 301. Antenna system 305 includes antenna 305-1 and antenna 305-2. Antenna 305-1 and antenna 305-2 may represent an embodiment of antenna 202-1 and antenna 202-2 discussed above in relation to FIG. 2. Accordingly, antenna 305-1 may operate as a radiator and antenna 305-2 may operate as a reflector. Alternatively, antenna 305-1 may operate as a reflector and antenna 305-2 may operate as a radiator. In this instance, FIG. 3 shows antenna 305-1 operating as the reflector and antenna 305-2 operating as the radiator. Thus, antenna 305-1 may redirect electromagnetic signals (not shown) received by antenna 305-2 away from antenna 305-1, thereby steering the antenna's main beam 306 away from human body 307.

Although not shown in FIG. 3, the direction in which an antenna's main beam may be steered may vary depending on various factors such as the strength of the connection signal, signal interference changes in communication needs, changes in available wireless networks, changes in geographic location, changes in the direction from which human body 307 is approaching, and/or any other changes that may affect the wireless communication of information handling system 300. For example, if human body 307 approaches information handling system 300 from direction 308, antenna 305-1 may switch to operate as a radiator and antenna 305-2 may switch to operate as a reflector, thereby steering the antenna's main beam 306 in direction 309.

Figure 4A:
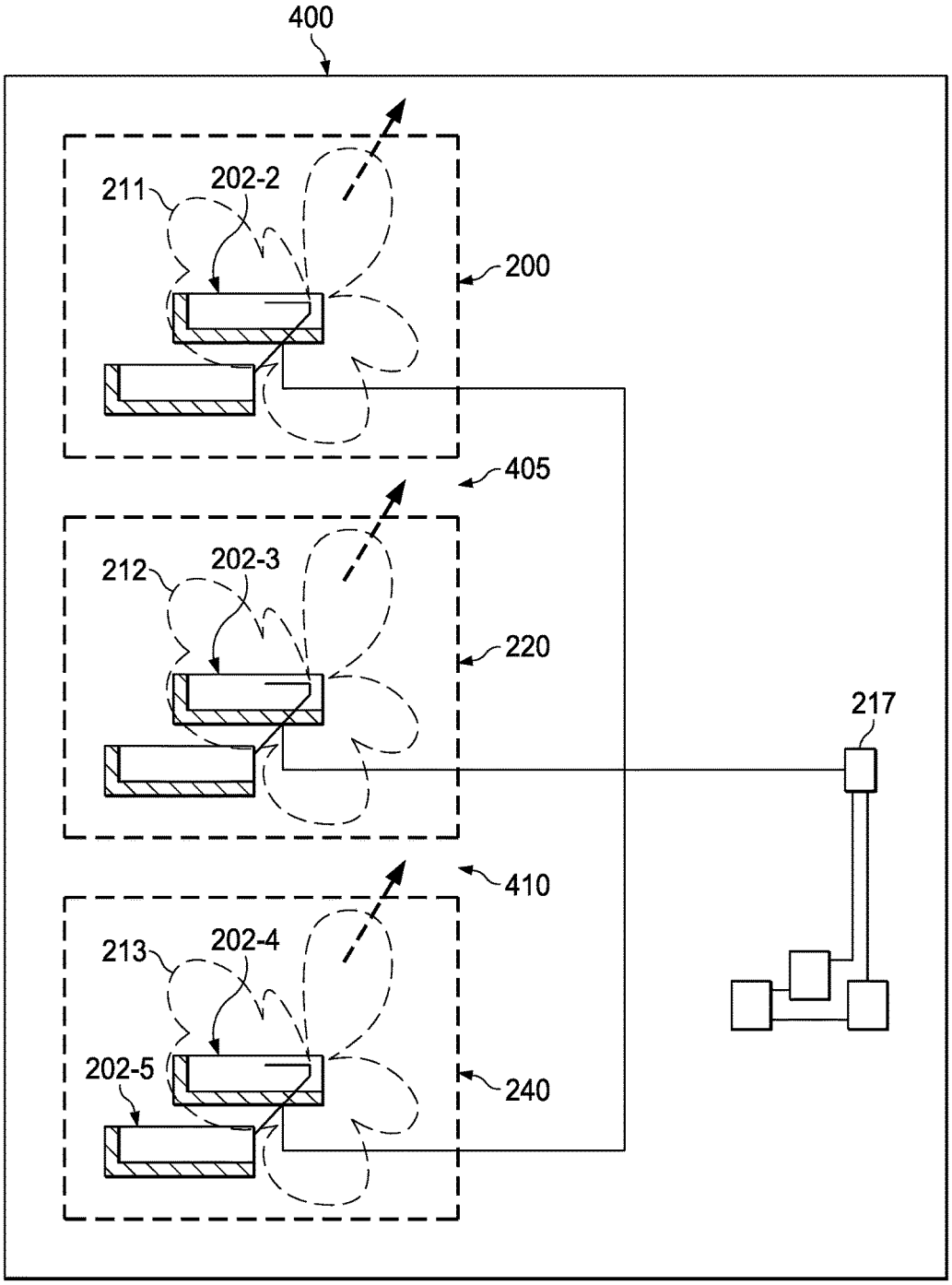
FIG. 4A is an isometric view of selected elements of an embodiment of stacked mirrored antenna systems used within an information handling system.
Figure 4B:
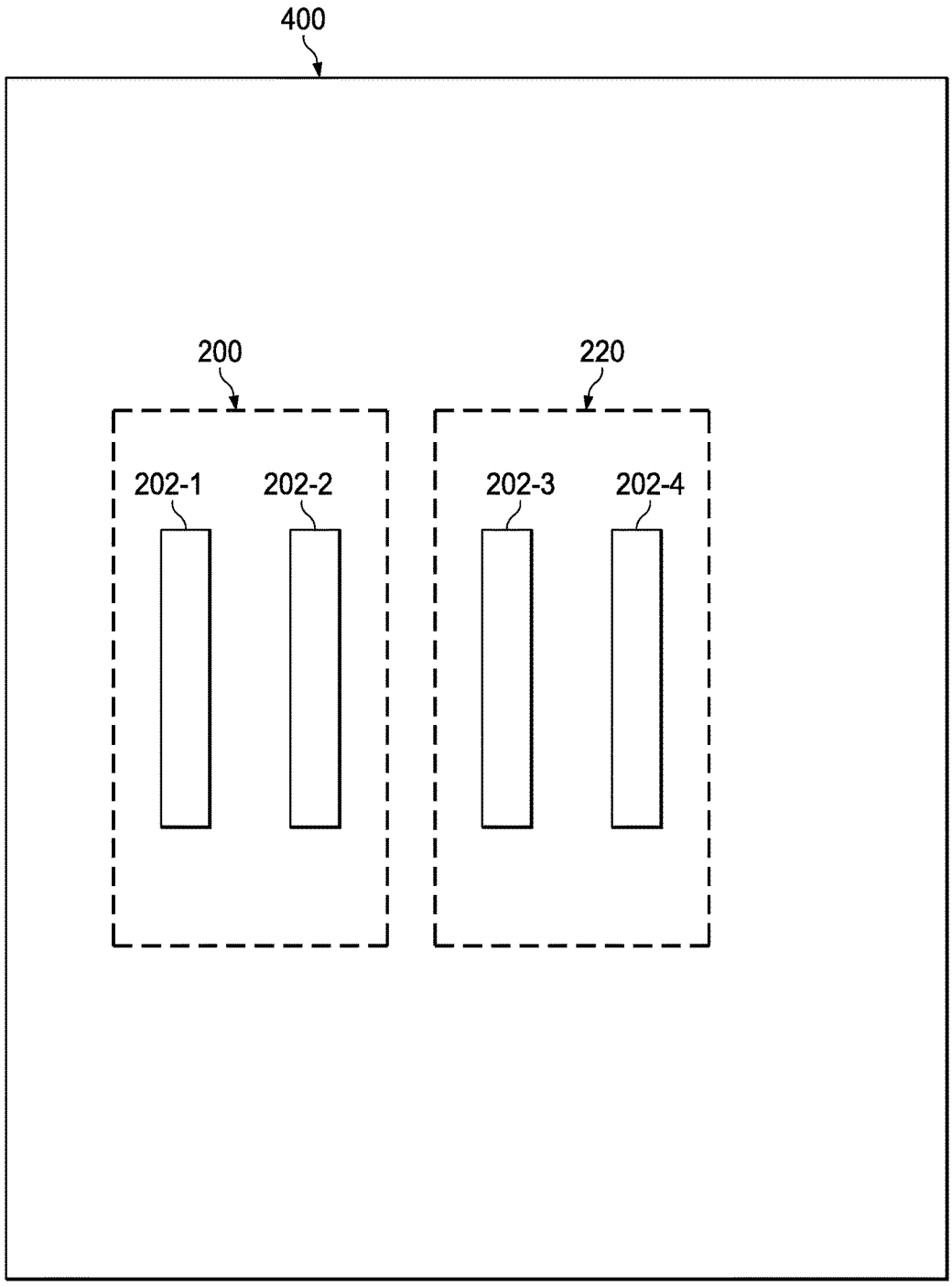
FIG. 4B is a block diagram of selected elements of an embodiment of stacked mirrored antenna systems used within an information handling system.

FIG. 4 shows an embodiment of mirrored antenna systems stacked within an information handling system. More specifically, FIG. 4A illustrates an embodiment of an information handling system 400 with mirrored antenna systems 200, 220, and 240 vertically stacked. FIG. 4B shows an embodiment of an information handling system 400 with mirrored antenna systems 200 and 220. The components shown in FIGS. 4A and 4B are not drawn to scale and may contain additional or fewer components than the components shown in FIGS. 4A and 4B. Information handling system 400 may implement an embodiment of information handling system 100 described above in reference to FIG. 1, and mirrored antenna system 220 and 240 may implement an embodiment of mirrored antenna system 200 described above with respect to FIG. 2.

Although FIG. 4A illustrates only three mirrored antenna systems stacked with each mirrored antenna system including only two antennas, other numbers and combinations may be used depending upon the operational objectives and the particular applications. For example, one mirrored antenna system may include three antennas instead of two antennas. Further, although mirrored antenna systems 200, 220, and 240 are shown vertically stacked, the mirrored antenna systems may be stacked in any manner or direction so long as the radiation patterns of each mirrored antenna system are aligned vertically with a space between each radiation pattern. For example, in FIG. 4A, mirrored antenna system 200, 220, and 240 may be stacked so that radiation patterns 211, 212, and 213 may be aligned vertically. Radiation patterns 211 and 212 may be separated by space 405 and radiation patterns 212 and 213 may be separated by space 410.

Mirrored antenna systems 200, 220, and 240 may be connected to switch 217 discussed above with respect to FIG. 2. Switch 217 may be any kind known in the art. For example, switch 217 may be an electromechanical switch such as a micro-electromechanical (MEM) switch, a single switch with multiple output ports, a semiconductor transistor switch, or any other type of switch suitable for switching RF signals. The switch may operate so that at any single time, only one antenna may be selected to operate as a radiator and only one antenna may be selected to operate as a reflector. For example, switch 217 may operate so that only antenna 202-2 is selected to operate as a radiator. Switch 217 may be configured to switch between each antenna 202 when there may be a change in the mirrored antenna systems. These changes may include changes in signal interference, changes in the strength of the connection signal, changes in communication needs, changes in geographic location, changes in available wireless networks, and/or any other change that may affect the wireless communication of mirrored antenna systems 200, 220, and 240. For example, if antenna 202-2 is operating as a radiator and its connection signal is weak, then switch 217 may switch so that antenna 202-3 may operate as a radiator if the connection signal with respect to antenna 202-3 is stronger than the connection signal associated with antenna 202-2. Similarly, if the connection signal associated with antenna 202-2 and antenna 202-3 is weaker than the connection signal associated with antenna 202-5, then switch 217 may select antenna 202-5 to operate as a radiator.

Depending upon the operational objectives desired to be achieved for particular applications, the antennas not selected to operate as a reflector or as a radiator my either be inactive or may operate as parasitic radiators. FIG. 4B shows each antenna 202 stacked and arranged in mirror symmetry within information handling system 400. Mirrored antenna system 200 may include antenna 202-1 and antenna 202-2. Mirrored antenna system 220 may include antenna 202-3 and antenna 202-4. Antenna 202-2 may be selected to operate as a radiator and antenna 202-4 may be selected to operate as a reflector. Antenna 202-1 and antenna 202-3 may be coupled to the main radiator, antenna 202-2, because of parasitic capacitance between antenna 202-1 and antenna 202-2 and between antenna 202-3 and antenna 202-2. Accordingly, antenna 202-1 and antenna 202-3 then may operate as parasitic radiators. Alternatively, antenna 202-3 may be selected to operate as a radiator, meaning that antenna 202-2 and antenna 202-4 may operate as parasitic radiators and antenna 202-1 may operate as a reflector.

Figure 5:
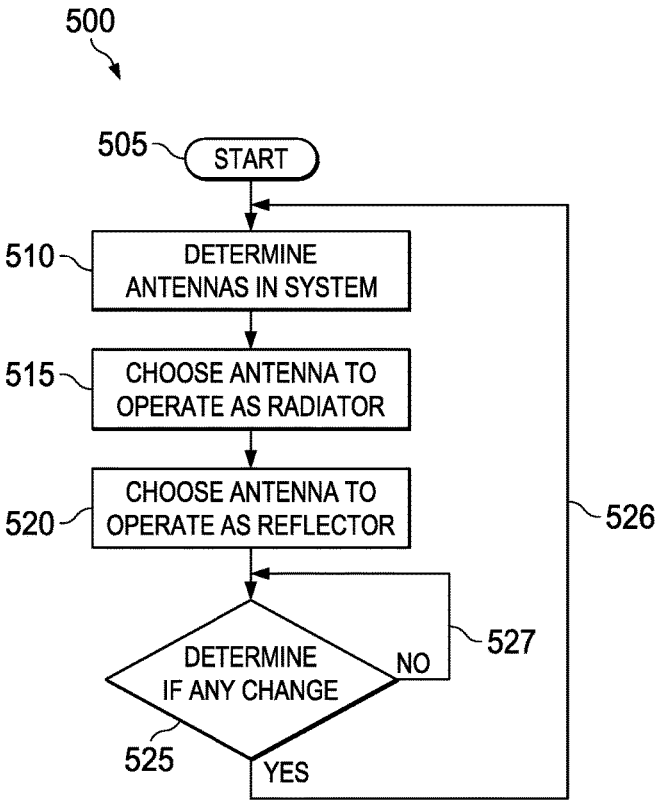
FIG. 5 is a flowchart depicting selected elements of an embodiment of a process for selecting an antenna in a mirrored antenna system used within an information handling system.

FIG. 5 is a flowchart showing the process of selecting an antenna to operate as a radiator within an information handling system. Although not explicitly stated in FIG. 5, process 500 may be used to select between two antennas in one mirrored antenna system and/or a plurality of antennas in a plurality of mirrored antenna systems. From start status 505, determination 510 may be made regarding which antennas may be available for operation. An antenna may then be chosen 515 to operate as a radiator based on the instructions, data, and operational parameters stored in wireless module 208 discussed above in reference to FIG. 2. Similarly, an antenna also may be chosen 520 to operate as a reflector based on the same instructions, data, and operational parameters stored in wireless module 208. The selected antennas may continue to operate until a determination 525 may be made regarding whether any changes in the antenna systems may have occurred. As explained above in reference to FIGS. 3 and 4, changes may include changes in signal interference, changes in the strength of the connection signal, changes in communication needs, changes in geographic location, changes in available wireless networks, and/or any other change that may affect the wireless communication of the antennas. If there is a change, then process 500 moves via decision yes 526 back to start status 505, so that the process may start over again. If there is not a change, then process 500 may loop back via decision no 527 to 525.

Figure 6:
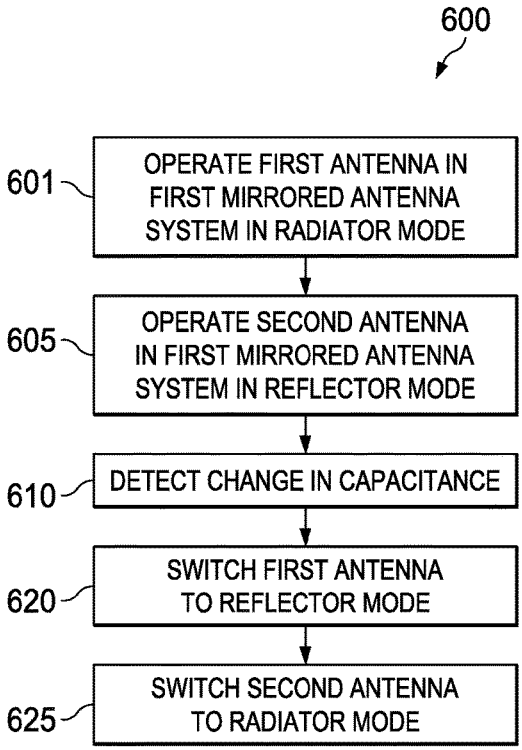
FIG. 6 is flowchart depicting selected elements of an embodiment of a method for beam steering in an information handling system.

FIG. 6 is a flowchart depicting selected elements of an embodiment of a method 600 for beam steering using a mirrored antenna system within an information handling system. Method 600 may be performed in accordance with various examples discussed in relation to FIGS. 2, 3, 4, and 5. In method 600, additional operations may be performed in addition to the explicit steps described. For example, determining the available antennas in the information handling system, as described above in reference to FIG. 5, may be performed prior to beginning method 600. Similarly, certain operations described in method 600 may be optional or may be rearranged in different embodiments.

In FIG. 6, first antenna 202-1 in first mirrored antenna system 200, as discussed above in reference to FIGS. 2 and 4, may operate 601 in radiator mode and second antenna

202-2 in first mirrored antenna system 200 may operate 605 in reflector mode. P-sensor 206-1 on first antenna 202-1 may detect 610 a change in capacitance upon the approach of a human body. This change in capacitance, along with the instructions, data, and operational parameters that may be stored in wireless module 208 described above in reference to FIG. 2, may be used to trigger switch 217. Accordingly, switch 217, as discussed above in reference to FIGS. 2, 3, and 4, may switch from the closed or on position to the open or off position with respect to first antenna 202-1, thereby allowing first antenna 202-1 to operate in reflector mode. Similarly, switch 217 may switch from the open or off position to the closed or on position with respect to second antenna 202-2, thereby allowing second antenna 202-2 to operate in radiator mode.

The above disclosed subject matter is to be considered illustrative, and not restrictive, and the appended claims are intended to cover all such modifications, enhancements, and other embodiments which fall within the true spirit and scope of the present disclosure. Thus, to the maximum extent allowed by law, the scope of the present disclosure is to be determined by the broadest permissible interpretation of the following claims and their equivalents, and shall not be restricted or limited by the foregoing detailed description.

What is claimed is:

1. A mirrored antenna system for beam steering, comprising:

a first mirrored antenna system that includes:

a first antenna and a second antenna each configured to operate alternatively as a first mirrored antenna system radiator and as a first mirrored antenna system reflector, wherein the first antenna and the second antenna are arranged in mirror symmetry to one another and separated by a dielectric medium; and a switch coupled to the first antenna and the second antenna configured to switch a feed in response to a trigger; and a second mirrored antenna system that includes:

a third antenna and a fourth antenna configured to operate alternatively as a second mirrored antenna system radiator and as a second mirrored antenna system reflector;

wherein the first mirrored antenna system and the second mirrored antenna system are stacked such that the radiation patterns of the first mirrored antenna system and the first mirrored antenna system are aligned vertically.

2. The mirrored antenna system of claim 1, wherein a size of a separation of the first antenna and the second antenna is dependent on an antenna volume.

3. The mirrored antenna system of claim 1, wherein the first antenna and the second antenna each includes a proximity sensor.

4. The mirrored antenna system of claim 1, wherein to operate alternatively as the first mirrored antenna system radiator and as the first mirrored antenna system reflector includes to respectively operate via a radiator mode and a reflector mode; and wherein the radiator mode and the reflector mode are mutually exclusive.

5. The mirrored antenna system of claim 1, wherein when the switch is in a closed or on position, the first antenna operates as the first mirrored antenna system radiator.

6. The mirrored antenna system of claim 5, wherein when the switch is in an open or off position, the first antenna operates as the first mirrored antenna system reflector.

7. An information handling system comprising:

a central processing unit;

a memory that is communicatively coupled to the central processing unit and that is configured to store instructions executable by the central processing unit;

a first mirrored antenna system for beam steering, the first mirrored antenna system including:

a first antenna and a second antenna configured to operate alternatively as a first mirrored antenna system radiator and as a first mirrored antenna system reflector, wherein the first antenna and the second antenna are arranged in mirror symmetry to one another and separated by a dielectric medium; and a switch coupled to the first antenna and the second antenna configured to switch a feed in response to a trigger; and a second mirrored antenna system, the second mirrored antenna system including:

a third antenna and a fourth antenna configured to operate alternatively as a second mirrored antenna system radiator and as a second mirrored antenna system reflector;

wherein the first mirrored antenna system and the second mirrored antenna system are stacked such that the radiation patterns of the first mirrored antenna system and the second mirrored antenna system are aligned vertically.

8. The information handling system of claim 7, wherein a size of a separation of the first antenna and the second antenna is dependent on an antenna volume.

9. The information handling system of claim 7, wherein the first antenna and the second antenna each includes a proximity sensor.

10. The information handling system of claim 7, wherein to operate alternatively as the first mirrored antenna system radiator and as the first mirrored antenna system reflector includes to respectively operate via a radiator mode and a reflector mode; and wherein the radiator mode and the reflector mode are mutually exclusive.

11. The information handling system of claim 7, wherein when the switch is in a closed or on position, the first antenna operates as the first mirrored antenna system radiator and when the switch is in an open or off position, the first antenna operates as the first mirrored antenna system reflector.

12. The information handling system of claim 7, further including a processor and a wireless module, the wireless module having instructions stored in the wireless module, the instructions being executable by the processor to switch the feed between the first antenna and the second antenna.

13. The information handling system of claim 12, wherein when the switch is in a closed or on position, the fit antenna operates as the first mirrored antenna system radiator and when the switch is in an open or off position, the first antenna operates as the first mirrored antenna system reflector.

14. The information handling system of claim 7, wherein the information handling system is a hinged device and the first mirrored antenna system is located proximally to a hinge of the hinged device.

15. The information handling system of claim 7, further comprising:

a sensor coupled to the switch and configured to detect a change in capacitance;

wherein the trigger is based at least on the sensor detecting the change in capacitance.

16. A method for beam steering in an information handling system, comprising:

operating, in a radiator mode, a first antenna in a first mirrored antenna system stacked with a second mirrored antenna system such that the radiation patterns of the first mirrored antenna system and the second mirrored antenna system are aligned vertically;

operating a second antenna in the first mirrored antenna system in a reflector mode in relation to the radiator mode of the first antenna;

switching the first antenna from the radiator mode to the reflector mode; and switching the second antenna from the reflector mode to the radiator mode.

17. The method of claim 16, wherein the radiator mode and the reflector mode are mutually exclusive.

18. The method of claim 16, wherein the second mirrored antenna system includes a third antenna and a fourth antenna configured to operate alternatively as a second mirrored antenna system radiator and as a second mirrored antenna system reflector.

19. The method of claim 18, further including operating only one antenna as a radiator at any given time.

20. The method of claim 16, further comprising:

determining a change in capacitance;

wherein the switching the first antenna from the radiator mode to the reflector mode and the switching the second antenna from the reflector mode to the radiator mode are performed in response to the determining the change in capacitance.

* * * * *